United States Patent [19]

Wakabayashi

[11] 4,354,435

[45] Oct. 19, 1982

[54] APPARATUS FOR TRANSFERRING CARRIERS AT DISCONTINUOUS PORTION OF POWER LINE FOR POWER-AND-FREE TROLLEY CONVEYOR

[75] Inventor: Takao Wakabayashi, Shinsenri-Minamimachi, Japan

[73] Assignee: Nakanishi Metal Works Co., Ltd., Osaka, Japan

[21] Appl. No.: 219,490

[22] Filed: Dec. 23, 1980

[51] Int. Cl.[3] ..... B61B 3/00

[52] U.S. Cl. ..... 104/172 S

[58] Field of Search ..... 191/1 R; 104/172 R, 104/172 S, 178

[56] References Cited

U.S. PATENT DOCUMENTS 3,913,494 10/1975 Coleson ..... 104/172 S 4,292,897 10/1981 Wakabayashi ..... 104/172 S

*Primary Examiner*—Richard A. Schacher

*Attorney, Agent, or Firm*—Armstrong, Nikaido, Marmelstein & Kubovcik

[57] ABSTRACT

In a power-and-free trolley conveyor, a carrier is transferred from a first power line to a second power line separated therefrom by being pushed forward from behind with a following pusher dog on the first power line.

1 Claim, 9 Drawing Figures

APPARATUS FOR TRANSFERRING CARRIERS AT DISCONTINUOUS PORTION OF POWER LINE FOR POWER-AND-FREE TROLLEY CONVEYOR

BACKGROUND OF THE INVENTION

This invention relates to an apparatus for transferring carriers at a discontinuous portion of the power line of power-and-free trolley conveyors.

With conventional power-and-free trolley conveyors, carriers are transferred from a first power line to a second power line over the discontinuous portion therebetween by a carrier propelling apparatus which is operated by a drive power separate from that for operating the power lines. Such an apparatus has the problem of requiring a very high equipment cost.

SUMMARY OF THE INVENTION

This invention has overcome the above problem and provides an appartus for use in power-and-free trolley conveyors for transferring carriers at a discontinuous portion of the power line.

In a power-and-free trolley conveyor, the apparatus of this invention is characterized in that a carrier is transferred from a first power line to a second power line over the discontinuous portion therebetween by being pushed forward from behind with a following pusher dog on the first power line.

The appartus of this invention is very simple in construction and yet is capable of transferring carriers reliably at the power line discontinuous portion without necessitating any additional carrier propelling apparatus. The present apparatus therefore has the advantage of being extremely low in equipment cost.

DESCRIPTION OF THE PREFERRED EMBODIMENT

Figure 1:
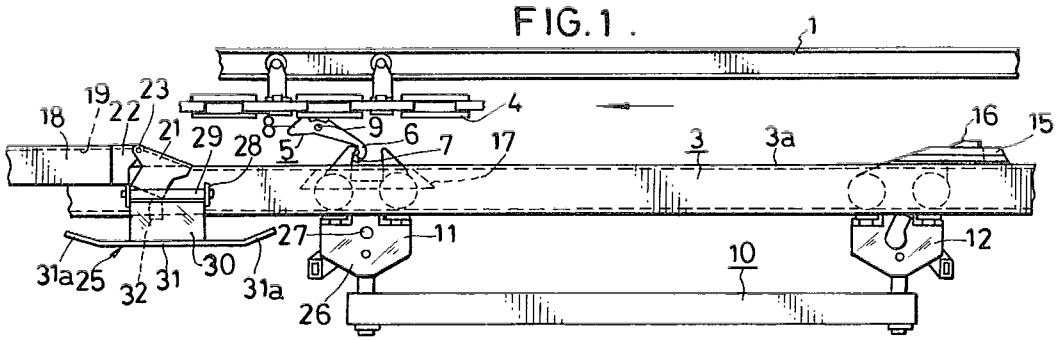
FIGS. 1 to 6 are fragmentary side elevations showing the power-and-free trolley conveyor of the invention during operation in sequential order.
Figure 2:
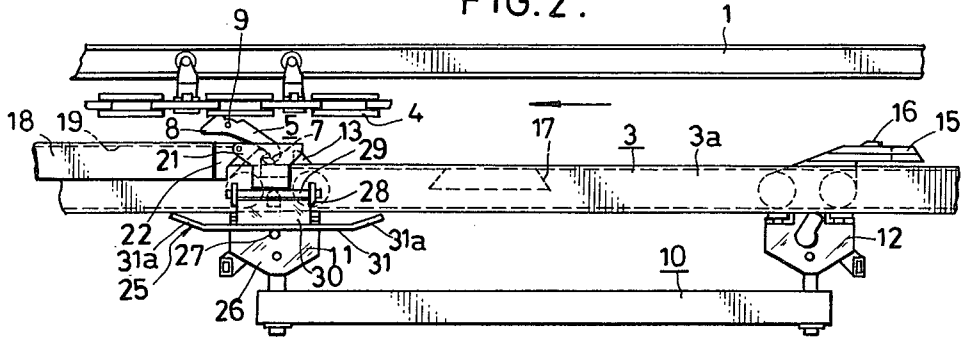
Figure 3:
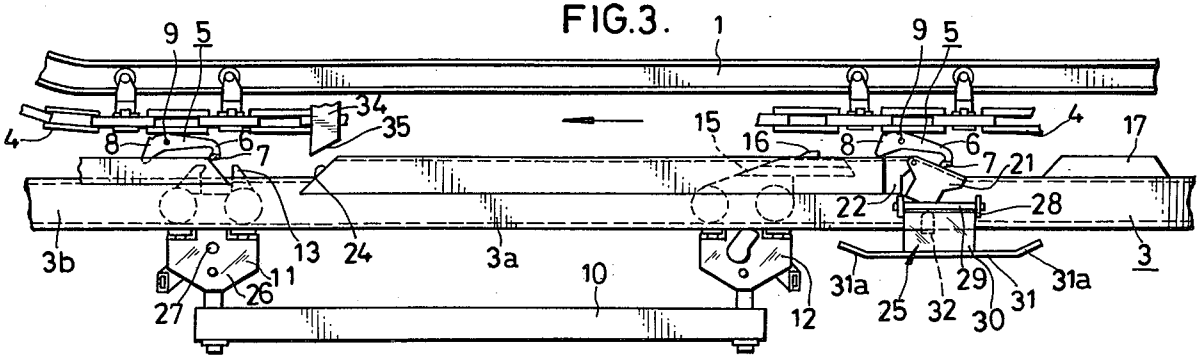
Figure 4:
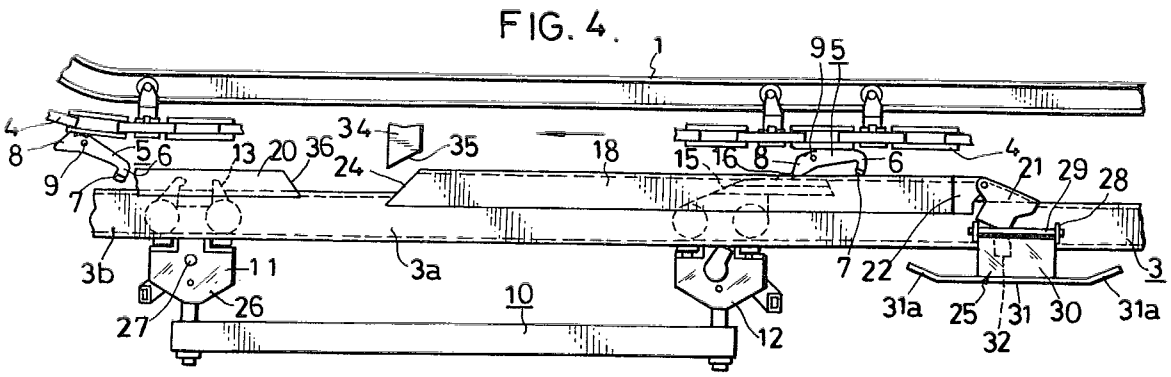

With reference to FIGS. 1 to 6, a first power line 1 and a second power line 2 are spaced apart from each other by a distance for the transfer of carriers. A free line 3 is coextensive with the lines 1 and 2 (see FIGS. 5 and 6). Each of the power lines 1 and 2 ha s a drive chain 4 carrying a multiplicity of pusher dogs 5 at a specified spacing. The pusher dog 5 has a front end stopper portion 8 which is usually in contact with the drive chain 4 from therebelow. In this position, the dog 5 extends downward toward its rear end which is provided with a hooked engaging portion 6 and side projections 7 extending outward from the opposite sides thereof. The pusher dogs 5 move forward when the drive chain 4 is driven.

Carriers 10 are supported by the free line 3 in suspension and each have free trolleys 11 and 12 at the front and rear ends respectively. The front free trolley 11 has a tilting dog 13 engageable with the hooked portion 6 of the pusher dog 5. The rear free trolley 12 is provided at its upper end with a rear projecting member 15 for accumulating following carriers 10. The rear projectng member 15 has bifurcated legs **15*a* at its rear end and an engaging projection 16 at the center of its top. At the front and rear ends, the projecting member 15 is sloped downward from the top wall toward its extremity. The rear projecting member 15 has a slightly smaller width than the track of the free line 3**.

Figure 8:
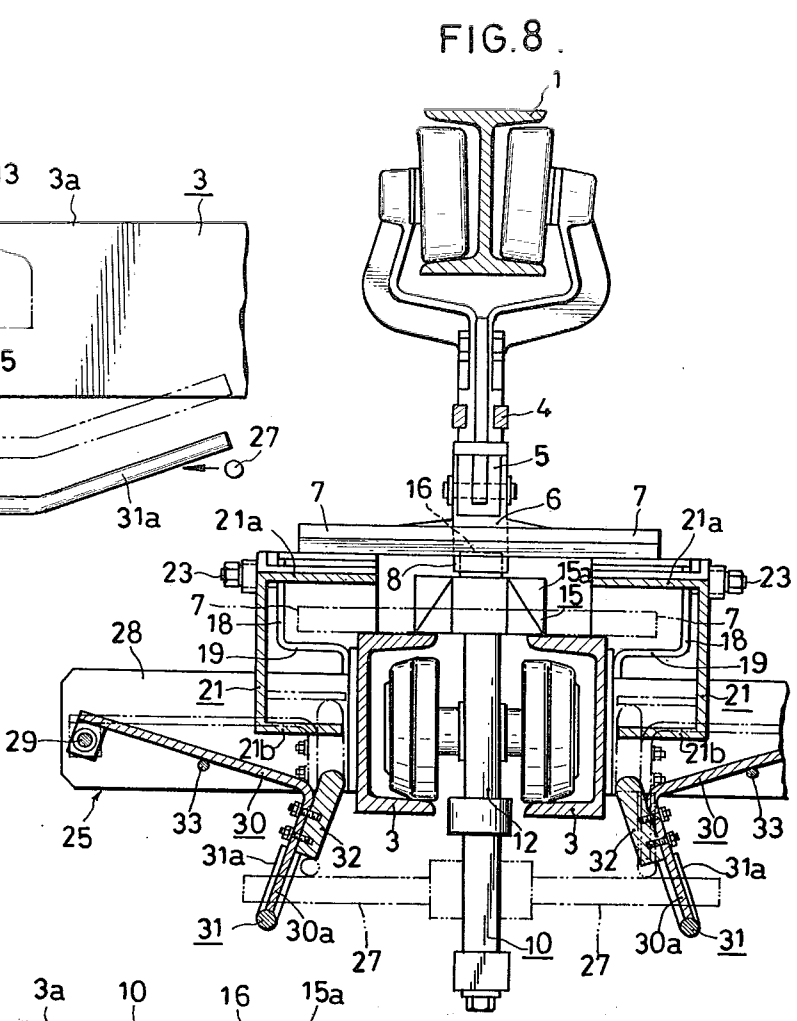
FIG. 8 is an enlarged view in section taken along the line VIII—VIII in FIG. 7.
Figure 7:
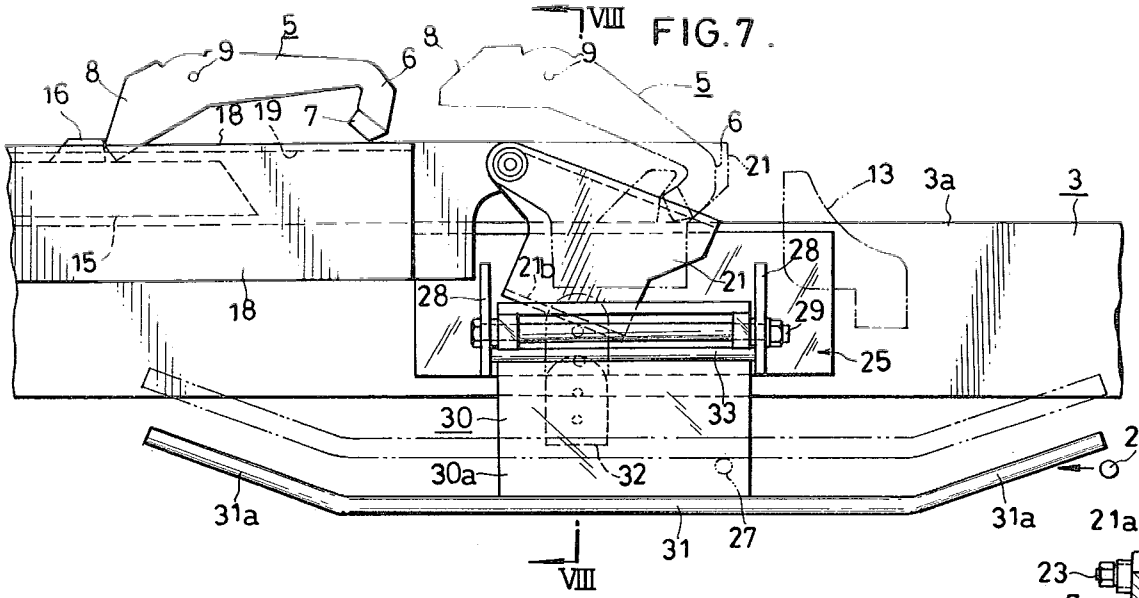
FIG. 7 is a fragmentary side elevation on an enlarged scale of FIG. 4.
Figure 9:
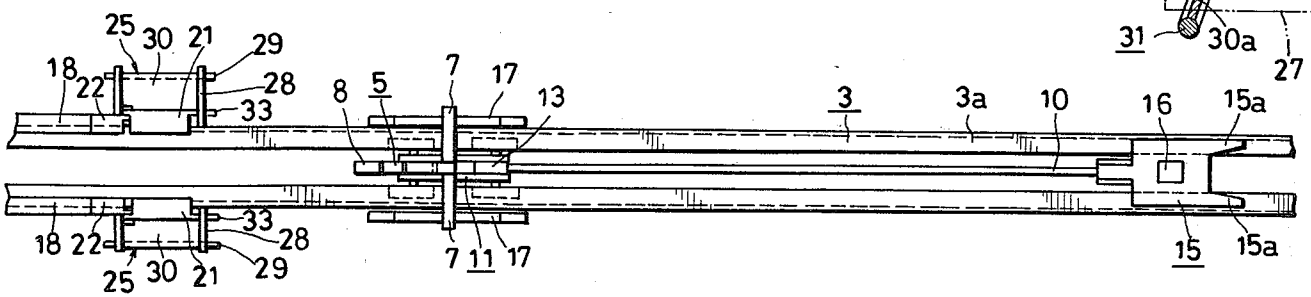
FIG. 9 is a plan view of FIG. 1.

The section **3*a* of the free line 3 below the first power line 1 is provided on its opposite sides with pusher dog disengaging first member 17, guide rails 18 for pushing the carrier from behind, and pusher dog disengaging second members 20 which are arranged in the order mentioned toward the direction of transport of the carriers 10 at predetermined spacings. The first members 17 are trapezoidal when seen sidewise and are movable into or out of the path of movement of the side projections 7 on the pusher dog 5. Each of the guide rails 18 is channel-shaped and has its opening directed inward. Each of the second members 20 is in the form of a plate-like rail. The guide rails 18 are provided at their starting ends with connecting members 22 on which channel-shaped pivotable guides 21 are supported by a rod 23. Each of the guide rails 18 has a terminal end 24 slanting forwardly downward from its top wall. Disposed below the pivital guide 21 are guide turning assemblies 25 which are operated by guide raising pins 27 extending from the opposite side walls 26 of the front free trolley 11. The guide turning assemblies 25 are shown in greater detail in FIGS. 7 and 8**.

A pair of brackets 28 extend outward from each rail side wall of the free line 3. A rod 29 extends between and is supported by the brackets 28. A guide turning member 30 L-shaped in cross section and pivotably supported by the rod 29 has a vertical wall **30*a* provided at its lower edge with an elongated lateral rod 31. The guide raising pin 27 raises the lateral rod 31 from below when coming into contact therewith. The vertical wall 30*a* has at the center of its upper edge an upward projection 32 for lifting the lower wall 21*b* of the guide 21 from below. The lateral rod 31 has slanting portions 31*a* slanting upward toward its opposite ends. A stopper 33 extends from one bracket 28 to the other at a specified level for supporting the guide turning member 30 at its lower limit position. Disposed close to and above the terminal ends of the guide rails 18 are guide members 34 having slanting lower ends 35 opposed to the slanting edges 24 of the rails 18 for forcibly lowering the side projections 7 on the pusher dog 5. The plate-like rail or second member 20 has a starting end 36** slanting rearwardly downward from its top.

The operation of the apparatus of the invention will be described below with reference to FIGS. 1 to 7.

When a carrier 10 is led onto the section **3*a* of the free line 3 below the first power line 1, the pusher dog 5 and the tilting dog 13 on the front free trolley 11 in engagement therewith move past the first members 17 which are trapezoidal when seen sideways and which have been held retracted downward from the path of movement of the side projections 7 on the pusher dog 5 (see FIG. 1**).

With the advance of the front free trolley 11, the guide raising pins 27 thereon come into contact with the slanting rear ends **31*a* of the lateral rods 31 of the turning assemblies 25. Since the pins 27 advance at the same level, the lateral rods 31, guide turning members 30 and the upward projections 32 are raised together, thereby pushing up the guides 21 from below and bringing the top walls 21*a*** thereof to the same level as the tops walls 18*a* of the guide rails 18 and the top walls 22*a* of the connecting members 22, with the result that a continuous channel is formed inside the guides 21, connecting members 22 and the guide rails 18. The side projections 7 on the pusher dog 5 pass through this channel along the upper face of the free rail 3. Accordingly the pusher dog 5 remains engaged with the tilting dog 13 (see these dogs indicated in broken lines in FIGS. 2 and 7).

With the passage of the guide raising pins 27 on the front free trolley 11, the guide turning members 30 and the guides 21 move down together under gravity. The turning members 30 are supported by the stoppers 33, while the top walls 21*a* of the guides 21 assume an inclined position with their free ends bearing on the free rail upper surface. When the pusher dog 5 reaches the starting ends of the second members 20, the side projections 7 ride onto the members 20, releasing the tilting dog 13 from the pusher dog 5. Consequently the carrier 10 comes to a halt after moving a small distance under inertia, permitting the rear projecting member 15 on the rear free trolley 12 to position at an intermediate portion of the guide rails 18. On the other hand, the next pusher dog 5 following this carrier 10 is disengaged from the following carrier 10 by the action of the first members 17 and advances singly. In some case the following pusher dog 5 may advance singly from the start without being accompanied by any carrier 10. The side projections 7 on the following pusher dog 5 move up the inclined top walls 21*a* of the guides 21 to the top walls 22*a* of the connecting members 22 and further to the top walls 18*a* of the guide rails 18, whereby the front end stopper portion 8 of the following pusher dog 5 is held in a substantially horizontal lowered position (see FIG. 3).

The following pusher dog 5 advances in this position, causing the front extremity of the stopper portion 8 on its lower side to come into striking engagement with the engaging projection 16 on the rear projecting member 15 of the preceding carrier 10 from behind. Consequently the preceding carrier 10 is pushed forward from behind by the advance of the following pusher dog 5 (see FIGS. 4 and 7).

Figure 5:
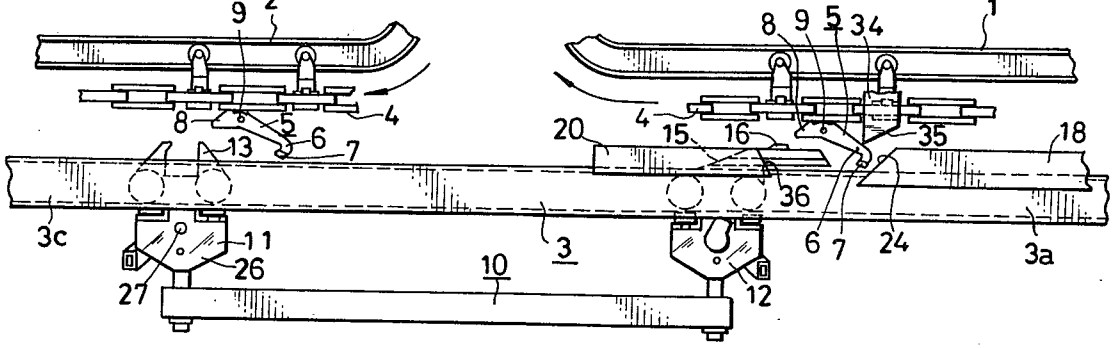
Figure 6:
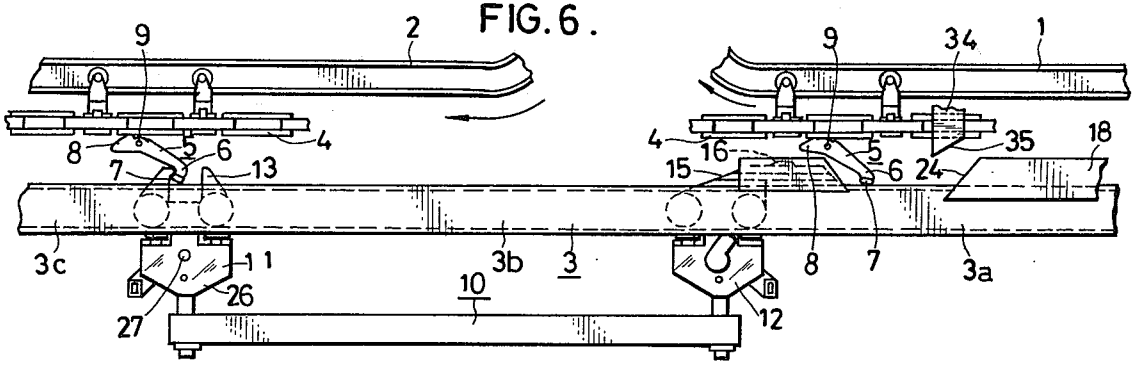

After the front free trolley 11 of the carrier 10 has passed an intermediate section 3*b* of the free line 3 below the power line discontinuous portion, the rear pushing dog 5 pushing the carrier 10 reaches the terminal ends of the guide rails 18, permitting the side projections 7 thereon to move down the slanting edges 24, whereby the front end stopper portion 8 of the pusher dog 5 is disengaged from the projection 16 (see FIG. 5).

The front free trolley 11 thus brought to another section 3*c* of the free line under the second power line 2 is now pulled by a pusher dog 5 on the second power line 2, whereby the carrier 10 is transferred to the second power line 2.

Although the front end stopper portion 8 of the pusher dog 5 of the illustrated embodiment is adapted at its extremity to strike and engage the projection 16 on the rear projecting member 15 of the carrier 10, the stopper portion 8 may be made to come into direct contact with a rear wall between the legs 15*a* of the projecting member 15. Further with the present embodiment, the pusher dog 5 has the side projections 7 on the opposite sides of its rear end which projections come into contact with the trapezoidal, vertically movable first members 17, guide rails 18, pivotable guides 21 and second members 20 which are all provided on the opposite sides of the free line 3. However, the side projection 7 may be formed on only one side of the pusher dog 5, so that the above members provided for the projection 7 may be provided only on one side of the free line 3, i.e. on the same side as the projection 7. The pusher dog disengaging first member 17 is not limited to the illustrated one; it can be another member which is positionable in, and retractable from, the path of movement of the side projection 7 on the dog 5. Although a plate-like rail is used as the pusher dog disengaging second member 20, another member is usable insofar as it is adapted to disengage the pusher dog 5.

The present invention may be embodied differently without departing from the spirit and basic features of the invention. Accordingly the embodiment herein disclosed is given for illustrative purposes only and is in no way limitative. It is to be understood that the scope of the invention is defined by the appended claims rather than by the specification and that various alterations and modifications within the definition and scope of the claims are included in the claims.

What is claimed is:

1. In a power-and-free trolley conveyor comprising a first power line and a second power line arranged discontinuously at a specified distance from each other, a free line disposed below the power lines and coextensive with the power lines at the discontinuous portion therebetween, carriers suspended from the free lne and each having a front free trolley and a rear free trolley, the front free trolley being provided with a tilting dog, the rear free trolley being provided at its upper end with a rear projecting member for accumulating following carriers, and pusher dogs pivoted to the drive chain of each of the power lines and arranged at a predetermined spacing, each of the pusher dogs being provided at its rear end with a hooked engaging portion and a side projection extenting from at least one side of the hooked engaging portion, the pusher dog having a stooper portion positioned at its front end to contact the drive chain from below, an apparatus for transferring the carriers at the power line discontinuous portion comprising a pusher dog disengaging first member, a guide rail for pushing the carrier from behind and a pusher dog disengaging second member arranged in the order mentioned toward the direction of transport of the carriers at predetermined spacings and mounted on a first section of the free line below the first power line, the first member being movable into or out of the path of movement of the side projection on the pusher dog, the guide rail being channel-shaped and having its opening directed inward, a pivotable guide in the form of a channel and attached to the starting end of the guide rail, a guide turning assembly disposed below the pivotable guide, and a guide raising pin extending from a side wall of the front free trolley of each of the carriers for operating the guide turning assembly, so that when the front free trolley of a carrier is led onto the first section of the free line by a pusher dog in engagement with the trolley, the front free trolley in engagement with the pusher dog moves past the first member, the pivotable guide and the guide rail and is released from the pusher dog by the second member to position the rear projecting member of the rear free trolley of the carrier at an intermediate portion of the guide rail, the next following pusher dog being subsequently disengageable from the following carrier by the first member and then movable along the top surface of the guide rail with its front end stopper portion lowered by the action of the guide to cause the stopper portion to strike and engage the rear projecting member of the preceding carrier from behind, the following pusher dog being thereby operable to push the preceding carrier forward from behind, causing the front free trolley thereof to move along an intermediate section of the free line below the power line discontinuous portion and reach a second section of the free line below the second power line, whereupon the following pusher dog is disengaged from the rear projecting member, subsequently permitting a pusher dog of the second power line to pull the front free trolley, whereby the preceding carrier is transferred to the second section of the free line below the second power line.

* * * * *